US005755385A

United States Patent [19]

Potz et al.

[11] Patent Number: 5,755,385

[45] Date of Patent: May 26, 1998

[54] FUEL-INJECTION VALVE FOR INTERNAL COMBUSTION ENGINES

[75] Inventors: Detlev Potz, Stuttgart; Guenter Lewentz, Hemmingen; Uwe Gordon, Markgroeningen, all of Germany

[73] Assignee: Robert Bosch GmbH, Stuttgart, Germany

[21] Appl. No.: 564,522

[22] Filed: Nov. 29, 1995

[30] Foreign Application Priority Data

Dec. 1, 1994 [DE] Germany ..... 44 42 764.6

[51] Int. Cl.[6] ..... F02M 59/00

[52] U.S. Cl. ..... 239/533.2; 239/533.9; 239/533.12; 239/584

[58] Field of Search ..... 239/533.1, 533.2, 239/533.3, 533.7, 533.8, 533.9, 533.12, 533.15, 583, 584, 585.4, 585.5; 137/625.3; 251/120

[56] References Cited

U.S. PATENT DOCUMENTS

| | | | |
|---|---|---|---|
| 2,035,202 | 3/1936 | Smith | 239/107.3 |
| 2,338,744 | 1/1944 | Szekely | 239/107.6 |
| 4,082,224 | 4/1978 | Mangus | 239/453 |
| 4,817,873 | 4/1989 | McKay | 239/533.12 |
| 4,842,018 | 6/1989 | White et al. | 137/625.3 |
| 5,405,088 | 4/1995 | Gordon et al. | 239/533.12 |
| 5,482,018 | 1/1996 | Potz et al. | 123/305 |
| 5,497,947 | 3/1996 | Potz et al. | 239/533.12 |
| 5,522,550 | 6/1996 | Potz et al. | 239/533.9 |

FOREIGN PATENT DOCUMENTS

| | | | |
|---|---|---|---|
| 0365131 | 4/1990 | European Pat. Off. . | |
| 0619426 | 10/1994 | European Pat. Off. . | |
| 2451462 | 5/1976 | Germany . | |
| 3719459 | 12/1988 | Germany . | |
| 4228359 | 12/1993 | Germany . | |
| 4228360 | 12/1993 | Germany . | |
| 4310154 | 10/1994 | Germany . | |
| 271562 | 5/1927 | United Kingdom | 239/533.12 |
| 1514600 | 6/1978 | United Kingdom . | |
| 1521065 | 8/1978 | United Kingdom . | |
| 2220984 | 1/1990 | United Kingdom | 239/533.12 |
| 2280712 | 2/1995 | United Kingdom . | |
| WO88/09869 | 12/1988 | WIPO . | |

*Primary Examiner*—Andres Kashnikow
*Assistant Examiner*—Lisa Ann Douglas
*Attorney, Agent, or Firm*—Edwin E. Greigg; Ronald E. Greigg

[57] ABSTRACT

A fuel injection valve for internal combustion engines, with an outward-opening valve member which, at one end projects out of a guide bore in a valve body. The valve has a valve head which acts as a closing member and on which is arranged a sealing face that cooperates with a valve seat on the valve body and which forms a sealing edge. For a variable injection cross section, a sleeve is attached onto the valve member on the region of the valve member located near the valve-member head, in which sleeve are provided a plurality of rows of injection orifices which can be opened in succession with an increasing opening stroke of the valve member. In order to allow a reliable and sealing guidance of the valve member, an inflow duct to the injection orifices is designed as a recess in the valve-member shank, in such a way that a web region guiding and sealing off the valve member in the sleeve remains.

23 Claims, 4 Drawing Sheets

FIG. 1
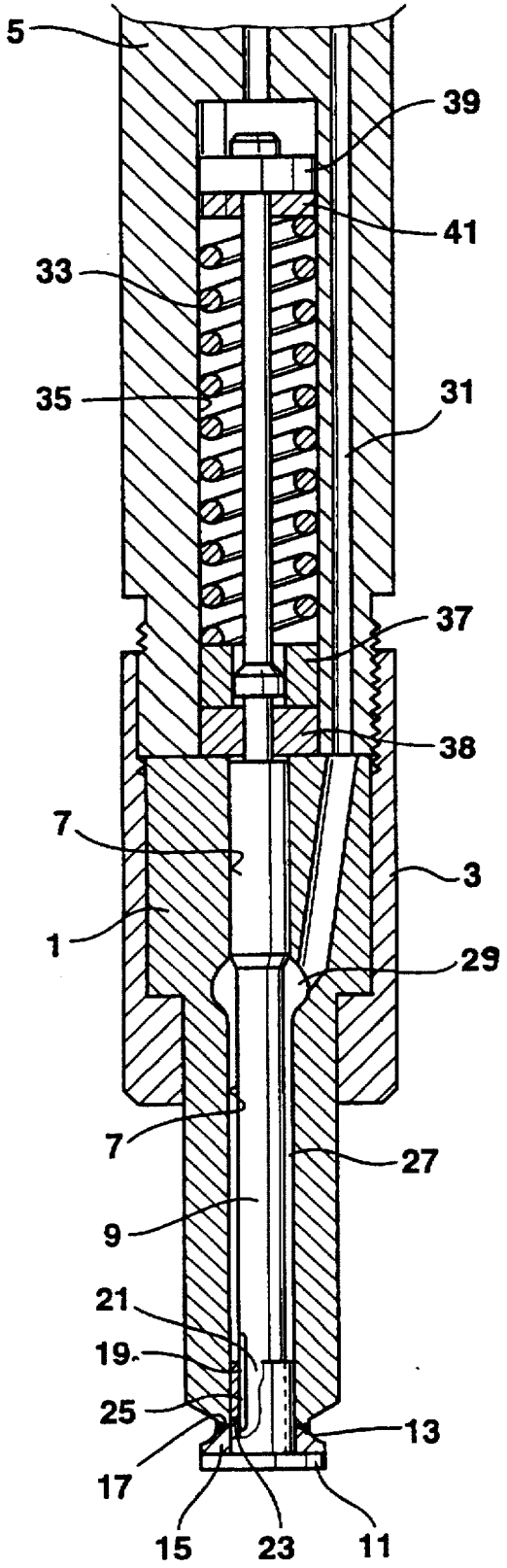
FIG. 8B
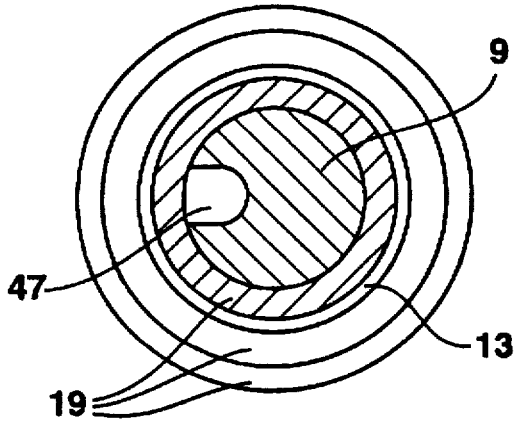
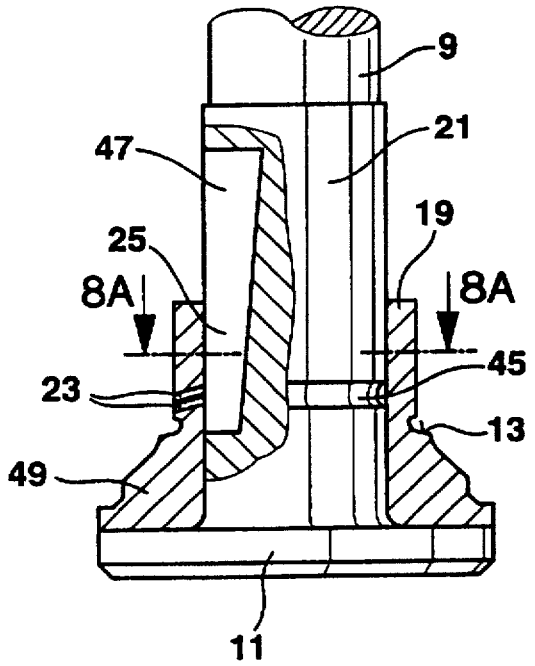
FIG. 8A

FIG. 2A
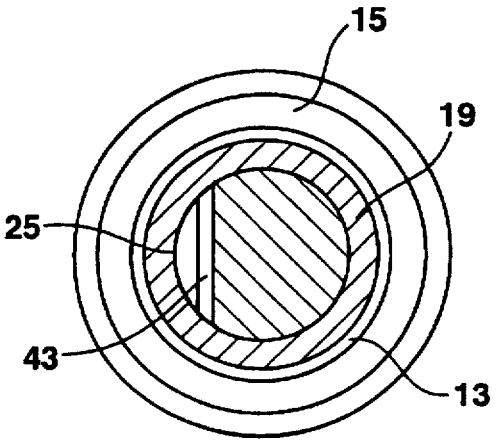
FIG. 3A
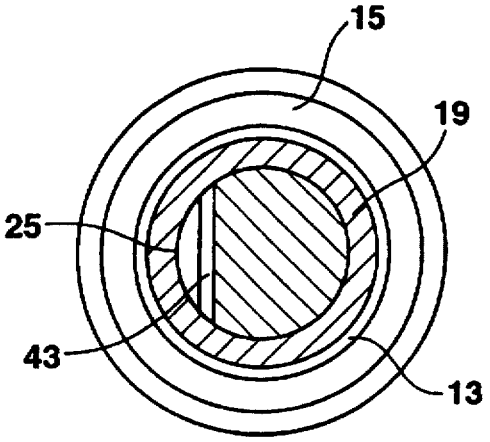
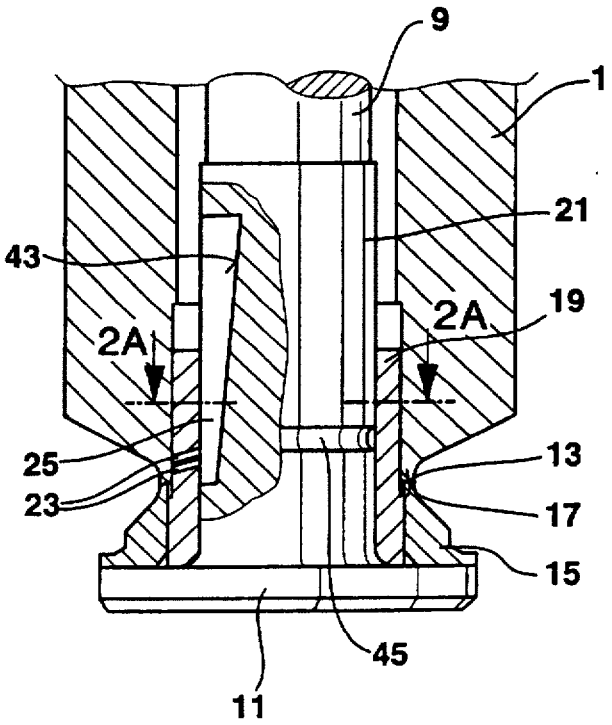
FIG. 2B
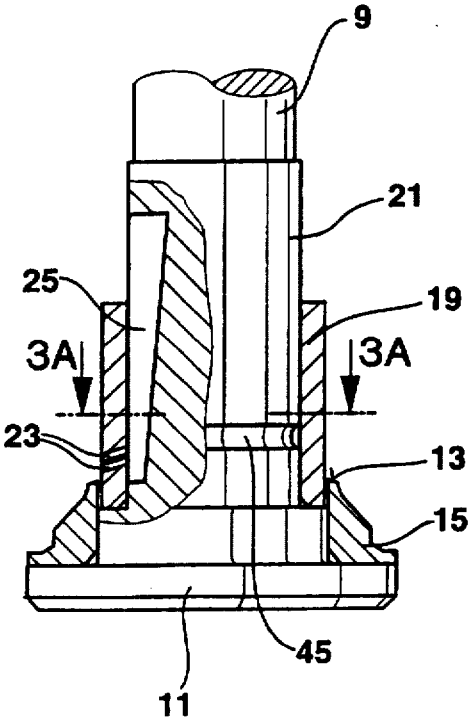
FIG. 3B

FIG. 4A
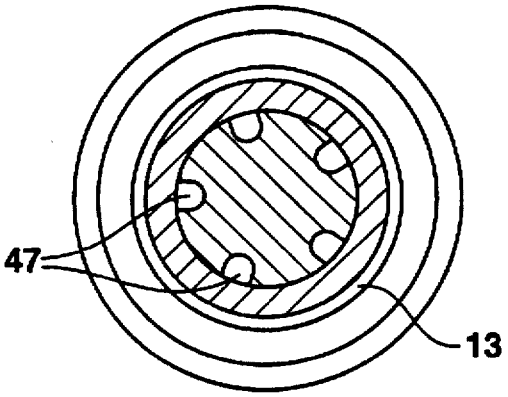
FIG. 5A
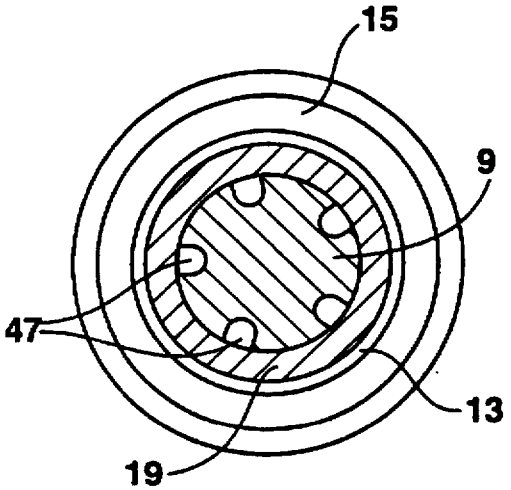
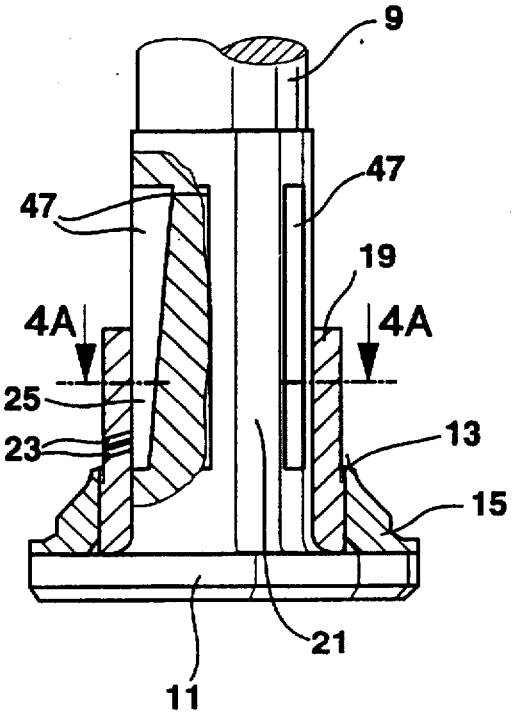
FIG. 4B
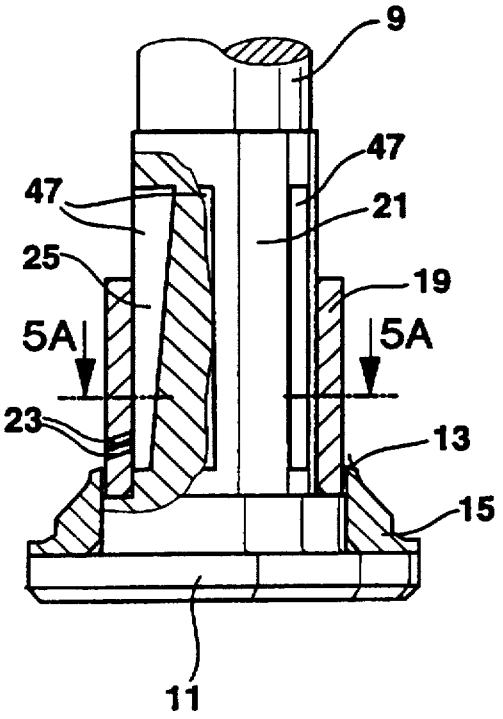
FIG. 5B

FIG. 6A
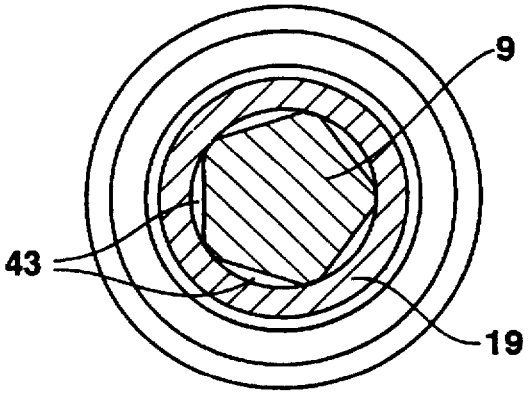
FIG. 7A
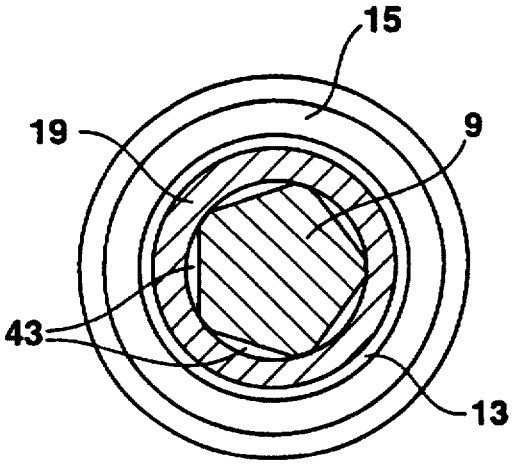
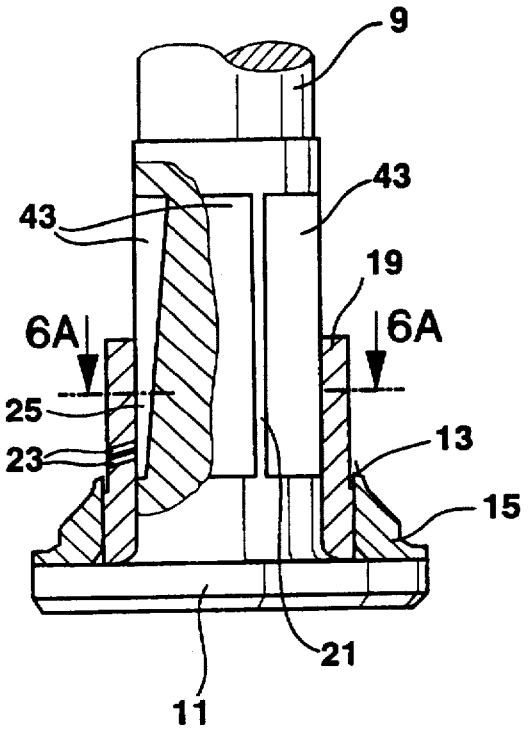
FIG. 6B
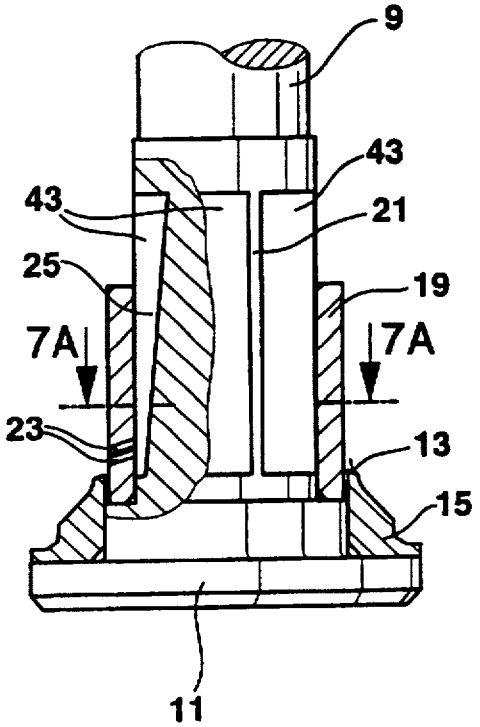
FIG. 7B

FUEL-INJECTION VALVE FOR INTERNAL COMBUSTION ENGINES

PRIOR ART

The invention relates to a fuel-injection valve for internal-combustion engines. In such a fuel-injection valve of the outward-opening type known from German Offenlegungsschrift 2,451,462, an axially displaceable valve member is guided in a bore of a valve body. The valve member has, at its end projecting into the combustion space of the internal-combustion engine to be supplied, a valve-member head of enlarged diameter, which emerges from the bore and on the side of the facing the valve body is arranged at least indirectly a sealing face which cooperates with a valve-seat face provided on the end face of the valve body. In this case, the valve member can be loaded via an inflow conduit and a pressure space with fuel high pressure fed by a high-pressure feed pump, in such a way that the valve member lifts off outwards from its valve seat counter to the force of a restoring or closing spring and opens, between the sealing face on the valve member and the valve-seat face, an opening cross section via which the fuel is injected out of the pressure space in the valve body into the combustion space of the internal-combustion engine to be supplied.

In order, at the same time, to achieve an opening cross section which is variable for different rotational speeds and load ranges of the internal-combustion engine, the valve member of the known injection valve has, at its end located on the combustion-space Bide, a sleeve which has the injection orifices and is supported with its end face located on the combustion-space side on the valve-member head and which, via a conical reduction in its outside diameter, forms the sealing face or sealing edge on the valve-member head, the sleeve being guided on its outer circumference in the valve body in the bore receiving the valve member. The injection orifices are formed in two rows, arranged axially one above the other, of injection orifices distributed uniformly over the circumference, the lower row near the combustion space being closely adjacent to the sealing face and the second, upper row being at a specific axial distance from this. At the same time, the inlet orifices opening out on the inner wall face of the sleeve and belonging to the injection orifices are connected, via an inflow duct formed between the shank of the valve member and the sleeve, to the pressure space fed by the fuel high-pressure pump.

Injection takes place as a result of the opening-stroke movement of the valve member, a sealing cross section between the valve-seat face and the sealing face on the valve head first being opened. Simultaneously or with a short delay (idle stroke), during the further course of the opening-stroke movement the lower row of injection orifices emerges from overlap with the valve body, thereby freeing a first opening cross section of injection orifices, via which the injection quantity passes into the combustion space of the internal-combustion engine. An enlargement of the effective opening cross section of the injection orifices in the case of a larger injection quantity and therefore a higher or longer supplied fuel high pressure is achieved by a continuation of the opening-stroke movement of the valve member, as a consequence of which the upper row of injection orifices also emerges from overlap with the valve body and frees an additional opening cross section.

However, the disadvantage of the known fuel-injection valve is that the sleeve and valve member are connected to one another only by a frictional connection which does not guarantee a firm fit of the sleeve on the valve member. Thus, in the known injection valve, in the course of the stroke movement an axial lifting-off of the sleeve from the valve-member head can occur, thereby impairing the accuracy of the opening cross sections of the injection orifices. Moreover, there is the risk that leakage fuel will escape undesirably at the annual bearing face between the sleeve and valve-member head, and this would considerably impair the injection operation and the treatment of the injected fuel in the combustion space of the internal-combustion engine.

A further disadvantage of the known injection valve is the relatively unstable axial guidance of the valve member which, at its end located on the combustion-space side, is guided, over a long axial region, solely on a narrow collar in the sleeve, so that, particularly under high injection pressures, deformations of the valve-member shank can occur and can likewise impair the accuracy of the fuel quantity to be injected.

ADVANTAGES OF THE INVENTION

In contrast to this, the advantage of the fuel-injection valve according to the invention for internal-combustion engines, is that an undesirable lifting-off of the sleeve carrying the injection orifices from the valve member can be reliably prevented. This takes place in a constructively simple way by pressing the sleeve onto the valve member in the region of the valve-member head over the entire axial length of the sleeve. The large bearing face between the valve-member shank and the sleeve guided in the bore of the valve body thus allows a reliable axial guidance of the valve member, so that injection inaccuracies as a result of a deformation of the valve member are prevented. Furthermore, as a result of the large-area press fit between the sleeve and valve member, the inflow duct formed between these components is reliably sealed off, so that an undesirable leakage escape can be avoided. At the same time, it is especially advantageous that the sleeve is pressed onto the valve member so as to be supported with its end face located on the combustion-space side on the valve-member head, since a positive connection in addition to a non-positive connection is also achieved thereby between the components, the press connection being essential. If this press connection were absent, there would be a continuous annular duct between the sleeve and the shank of the valve member and the sleeve would be loaded on its entire inner cylindrical surface with the injection pressure, and this could lead to an expansion in the diameter of the sleeve, which, particularly under high injection pressures, can quickly cause a jamming of the sleeve axially displaceable in the bore of the valve body.

Moreover, a continuous decrease in the cross section of the inflow duct in the direction of the injection orifices achieves in an advantageous way an acceleration of the fuel flow which, in cooperation with the geometry of the injection orifices in the sleeve, leads to an improved jet treatment in the combustion space of the internal-combustion engine to be supplied.

A further advantage of the design according to the invention of the inflow duct is that the dead volume of the inflow duct is smaller than that in the known injection valve, thus, in particular, having a positive effect on the fuel pressure during injection.

A further advantage is attained by providing on the valve-member head an additional seat ring carrying the sealing face, since the idle stroke can now be avoided. It is possible, at the same time, to press the seat ring onto the sleeve or the valve-member head directly, the version pressed onto the sleeve being simple to produce. A very exact arrangement of the support ring and therefore of the sealing face is possible by means of the arrangement directly on the valve head, the straight run of the seat line on the valve-member head thereby having smaller deviations in relation to the upper guidance of the valve member.

Further advantages and advantageous embodiments of the subject of the invention can be taken from the description, the drawing and the patent claims.

BRIEF DESCRIPTION OF THE DRAWINGS

Four exemplary embodiments of the fuel-injection valve according to the invention for internal-combustion engines are represented in the drawings and are explained in more detail in the following description.

FIG. 1 shows a longitudinal section through the injection valve according to the invention, FIGS. 2*a* and 2*b* and 3*a* and 3*b* are a first exemplary embodiment, in which the inflow duct is designed in the form of a portion ground down on one side on the valve-member shank, the figures each being represented in a longitudinal section and cross section, FIGS. 4*a*, 4*b* and 5*a*, 5*b* are a second exemplary embodiment, in which the inflow duct is formed from a plurality of axial grooves, FIGS. 6*a*, 6*b* and 7*a*, 7*b* are a third exemplary embodiment, in which the inflow duct is produced in the form of a plurality of ground-down portions, and FIG. 8*a*, 8*b* are a fourth exemplary embodiment, in which the inflow duct is formed by a single deep axial groove and in which the sealing face of the valve-member head is arranged directly on the sleeve, whereas, in the other exemplary embodiments, the sealing face is arranged on a seat ring which is pressed directly onto the valve-member head or the sleeve.

DETAILED DESCRIPTION OF THE EXEMPLARY EMBODIMENTS

The fuel-injection valve represented in FIG. 1 has a valve body 1 which is clamped to a valve holder 5 by means of a union nut 3. Mounted axially displaceably in a guide bore 7 in the valve body 1 is a piston-shaped valve member 9 which, at its lower end projecting into a combustion space of the internal-combustion engine to be supplied, carries a valve-member head 11 acting as a closing head. This valve-member head 11 has a conical sealing face 13 which faces the valve body 1 and which, in FIG. 1, is formed by a seat ring 15 placed onto the valve-member head 11 and cooperates with a corresponding valve-seat face 17 on the end face of the valve body 1 located on the combustion-space side. Moreover, a sleeve 19 is placed onto a portion 21 of the valve-member shank adjacent to the valve-member head 11, various injection orifices 23 being provided in the sleeve 19 and its design being discussed in more detail during the description of the individual exemplary embodiments. The injection orifices 23 are connected via an inflow duct 25, which is formed between the valve-member shank and the sleeve 19 and the embodiments of which are likewise explained in more detail later, and an annular gap 27 between the valve member 9 and the guide bore 7 to a pressure space 29 or collecting space formed by a cross sectional widening. This pressure space 29 is constantly connected via a pressure conduit 31 to a pump working space (not shown) of a fuel high-pressure pump which loads it alternately with fuel high pressure.

For loading the valve member 9 with force axially in the closing direction, there is inserted into a spring space 35 in the valve holder 5 a closing spring 33 which is supported via an annular insert 37 and a spacer ring 38 on the end face of the valve body 1 remote from the combustion space and which acts on the valve member 9 via a holding ring 39, arranged at the end of the valve member 9 facing away from the combustion space, and an adjusting washer 41.

Various exemplary embodiments of the inflow duct 25, of the arrangement of the sealing face 13 of the valve member 9 and of the fastening of the sleeve 19 and seat ring 15 to the valve-member head 11 are explained below with reference to FIGS. 2 to 8. Of these, FIGS. 2 and 3 show a first exemplary embodiment of the design of the inflow duct 25 between the sleeve 19 and valve-member shank, for which purpose a longitudinal section and a cross section of the corresponding valve-member parts are shown in each case. To this effect, the valve member 9 has in FIG. 2, on its portion 21 overlapped by the sleeve 19 and located near the valve-member head, a plane ground-down portion 43 which extends axially from a region outside the overlap with the sleeve 19 at least into the region of overlap with the injection orifices and the base of which is inclined in such a way that the depth of the ground-down portion 43 decreases in the direction of the valve-member head 11, alternatively a cross sectional reduction by a decrease in the width of the ground-down portion 43 also being possible. At the same time, the sleeve 19 is pressed with its inner wall face onto the remaining part of the cylindrical surface of the valve-member shank on the portion 21 and comes to bear on this with its end face facing the valve-member head 11, so that its axial length is unequivocally fixed geometrically. The sleeve 19 slides with its outer circumference in a part of widened diameter of the guide bore 7. The injection orifices 23 are arranged in the sleeve 19 in the form of bores which are inclined radially outwards in the direction of the valve-member head 11. In this case, preferably two rows, located axially one above the other, of injection orifices 23 are provided, these being arranged distributed uniformly in a radial plane on the circumference of the sleeve, the outlet orifices of the lower row being arranged level with the inner annular edge of the sealing face 13 or slightly higher than this. For supplying all the injection orifices 23 on the circumference of the sleeve, an annular groove 45 level with the inlet orifices of the injection orifices 23 is provided in the portion 21.

In FIGS. 2*a* and 2*b*, the seat ring 15 forming the sealing face 13 on the valve member 9 is pressed onto the sleeve 19 and comes with its end face located on the combustion-space side to bear on the valve-member head 11 forming an annular shoulder.

FIGS. 3*a* and 3*b* differs from FIG. 2*a* and 2*b* only in the fastening of the sleeve 19 and of the seat ring 15, in this case the seat ring 15 being pressed directly onto the valve-member head 11. The end of the sleeve 19 located on the combustion-space side terminates just behind the inner annular edge of the sealing face 13. In the second exemplary embodiment which is illustrated in FIGS. 4*a* and 4*b* and 5*a*, 5*b* and which are shown similarly to the representation of the first exemplary embodiment, in each case in two views, the inflow duct 25 is formed between the sleeve 19 and valve-member shank in the portion 21 by means of a plurality of, preferably 5, axial grooves 47 which correspond to the number of injection orifices in a radial plane and are located in the valve-member shank and which overlap the inlet orifices, in each case located axially one above the other, of the injection orifices 23 in the sleeve 19. At the same time, the cross section of the axial grooves is also to decrease continuously in the direction of the injection orifices, which, as shown, can be achieved by a reduction in the depth of the axial grooves 47 or a reduction in their width. At the same time, similarly to the first exemplary embodiment described in FIGS. 2*a*, 2*b* and 3*a*, 3*b*, it is possible to press the seat ring 15 carrying the sealing face 13 onto the sleeve 19 (FIGS. 4*a*, 4*b*) or directly onto the valve-member head 11 (FIGS. 5*a*, 5*b*).

In the third exemplary embodiment represented similarly to FIGS. 2*a* to 5*b* in FIGS. 6*a*, 6*b* and 7*a*, 7*b*, the inflow duct 25 is formed between the sleeve 19 and the valve-member shank in the portion 21 by a plurality of plane ground-down portions 43 which correspond to the number of injection orifices 23 in a radial plane and are located on the valve-member shank and which extend from a region outside the overlap with the sleeve 19 axially into the region of the injection orifices 23 and the cross section of which, as in the preceding examples, decreases in the direction of the injection orifices by a reduction in the depth or width. At the same time, despite a large throughflow cross section to the injection orifices 23, there still always remains a sufficient guidance cross section, distributed uniformly over the circumference of the valve-member shank, of the valve member 9 on the sleeve 19 (web regions between the ground-down portions 43), on which guidance cross section the sleeve 19 is pressed onto the valve member. The arrangement of the sleeve 19 and seat ring 15 on the valve-member head 11 corresponds to the two possibilities described in FIGS. 2*a* to 5*b*.

The fourth exemplary embodiment shown in FIGS. 8*a*, 8*b* similarly to the mode of representation of FIGS. 2 to 7*b* differs from the previous exemplary embodiments first in that the sleeve 19 and seat ring 15 form a common one-piece component. For this purpose, in FIG. 8*a*, 8*b*, the sleeve 19 has, at its end located on the combustion-space side, a conical cross sectional widening 49, of which a part region adjoining below the injection orifices 23 forms the sealing face 13. In the fourth exemplary embodiment, the inflow duct 25 between the sleeve 19 and the valve-member shank in the portion 21 is formed by a single deep axial groove 47 which is located in the valve-member shank and the cross section of which decreases in the direction of the injection orifices 23 similarly to the preceding inflow ducts 25. In order to obtain all the injection orifices 23 on the circumference of the sleeve 19, moreover, an annular groove 45 is provided level with the injection orifices on the valve-member shank.

The fuel-injection valve according to the invention works as follows.

In the state of rest, that is to say when there is no high-pressure feed of the high-pressure pump assigned to the fuel-injection valve, the closing spring 33 keeps the valve member 9 bearing with its sealing face 13 on the valve-seat face 17 on the valve body 1, so that the injection valve is closed. During the injection operation, the fuel fed by the high-pressure feed pump passes in a known way via the pressure conduit 31, the pressure space 29 and the annular gap 27 as far as the valve-member portion 21, on which the sleeve 19 is arranged. The end face of the sleeve 19 facing away from the combustion space acts as a pressure engagement face which, together with the axial end face of the inflow duct 25, is made larger than the pressure faces acting in the closing direction and located on the valve member 9, so that the fuel pressure lifts off the valve member 9 outwards from the valve seat 17 counter to the force of the closing spring 33.

With the commencement of this opening-stroke movement of the valve member or shortly thereafter (idle stroke), first the lower row of injection orifices 23 emerges from overlap with the valve body 1, so that the fuel bearing via the inflow duct 25 on their inlet orifices can be injected in jet form via the injection orifices into the combustion space of the internal-combustion engine to be supplied. At the same time, it is particularly advantageous that the cross section of the inflow duct decreases, since the flow velocity of the fuel can thus be increased, thereby leading to a better swirling of the fuel in the injection orifices 23 and consequently to a better mixture treatment of injected fuel in the combustion space.

At the same time, depending on the injection quantity and pressure, a larger injection cross section is to be opened if the opening-stroke movement of the valve member 9 is increased, so that the upper row of injection orifices 23 is also opened and thus frees an additional injection cross section.

The end of injection takes place as a result of the termination of the supply of the fuel high pressure, so that the closing spring 33 moves the valve member 9 back onto the valve seat 17 again. It is thus possible, by means of the fuel-injection valve according to the invention, to guide the valve member reliably and sealingly and, at the same time, to allow an optimum supply of fuel to the injection orifices which is simple to produce.

The foregoing relates to preferred exemplary embodiments of the invention, it being understood that other variants and embodiments thereof are possible within the spirit and scope of the invention, the latter being defined by the appended claims.

We claim:

1. A fuel-injection valve for internal-combustion engines of the outward-opening type, comprising a valve body (1), a bore (7) in said valve body, a valve member (9) which is displaceable axially in said bore (7) of said valve body (1) by a fuel pressure counter to a force of a closing spring (33) and which, at an end of said valve body located on a combustion-space side of said valve, a valve-member head (11) forms a valve-closing member and, on a side of said valve member head (11) facing the valve body (1), said valve member head (11) has at least indirectly a sealing face (13) which forms a sealing edge, said sealing face (13) cooperates with a valve-seat face (17) provided on an end face of the valve body (1) located on the combustion-space side, a sleeve (19) is arranged on the valve member (9) and protrudes into the bore (7) and is provided with injection orifices (23) which are opened as a result of an opening-stroke movement of the valve member (9) and connectable to a pressure space (29) surrounding said valve member, an inflow duct (25) is formed by at least one recess, covered by the sleeve (19), on a portion (21) of the valve member (9) near the valve-member head (11), and the sleeve (19) sits firmly on the circumference of said portion (21) of the valve member (9) and forms an axial guide of the valve-member head (11) relative to the valve body (1), and the sleeve (19) is press-fitted between recesses over an entire axial length of the sleeve onto the valve member (9) in a region of said portion (21) of the valve member head (11).

2. A fuel injection valve as claimed in claim 1, wherein the inflow duct (25) is formed by a plurality of axial-ground-down portions (43) which correspond to the number of injection orifices (23) arranged in a radial plane in the sleeve (19) and which are located in a shank of the valve member (9) in the portion (21) of an overlap with the sleeve (19) upstream of the valve member head (11).

3. A fuel-injection valve as claimed in claim 1, wherein the sealing face (13) on the valve-member head (11) is formed by a seat ring (15) placed onto the valve-member head (11) having a shoulder which is adjacent to a shank part of the valve member (9) and on which the seat ring (15) comes to bear sealingly on the combustion-space side.

4. A fuel-injection valve as claimed in claim 3, wherein the sleeve (19) is made in one piece with the seat ring (15).

5. A fuel injection valve as claimed in claim 3, wherein the inflow duct (25) is formed by a plurality of axial ground-down portions (43) which correspond to the number of injection orifices (23) arranged in a radial plane in the sleeve (19) and which are located in a shank of the valve member (9) in the portion (21) of an overlap with the sleeve (19) upstream of the valve member head (11).

6. A fuel injection valve as claimed in claim 3, wherein the inflow duct (25) is formed by a plurality of axial grooves (47) which correspond to the number of injection orifices (23) arranged in a common radial plane of the sleeve (19) and are located in a shank of the valve member (9) in the portion (21) of an overlap with the sleeve (19) upstream of the valve member head (11) and which extend from the pressure space (29) into the region of the inlet orifices of the injection orifices (23).

7. A fuel injection valve as claimed in claim 3, wherein the seat ring (15) has in cross section essentially the form of a right-angled triangle including legs which come to bear sealingly on the shoulder and on the shank of the valve member (9).

8. A fuel injection valve as claimed in claim 4, wherein the inflow duct (25) is formed by a plurality of axial ground-down portions (43) which correspond to the number of injection orifices (23) arranged in a radial plane in the sleeve (19) and which are located in a shank of the valve member (9) in the portion (21) of an overlap with the sleeve (19) upstream of the valve member head (11).

9. A fuel injection valve as claimed in claim 4, wherein the inflow duct (25) is formed by a plurality of axial grooves (47) which correspond to the number of injection orifices (23) arranged in a common radial plane of the sleeve (19) and are located in a shank of the valve member (9) in the portion (21) of an overlap with the sleeve (19) upstream of the valve member head (11) and which extend from the pressure space (29) into the region of the inlet orifices of the injection orifices (23).

10. A fuel injection valve as claimed in claim 4, wherein the inflow duct is formed by a portion (43) ground down on one side on a shank of the valve member (9) in the portion (21) of an overlap with the sleeve (19) upstream of the valve member head (11) which opens, at its end located on the combustion-space side, into an annular groove (45) which is located on the valve-member shank and which overlaps the inlet orifices of the injection orifices (23) in the inner wall of the sleeve (19).

11. A fuel injection valve as claimed in claim 4, wherein the seat ring (15) has in cross section essentially the form of a right-angled triangle including legs which come to bear sealingly on the shoulder and on the shank of the valve member (9).

12. A fuel injection valve as claimed in claim 3, wherein the inflow duct is formed by a portion (43) ground down on one side on a shank of the valve member (9) in the portion (21) of an overlap with the sleeve (19) upstream of the valve member head (11) which opens, at its end located on the combustion-space side, into an annular groove (45) which is located on the valve-member shank and which overlaps the inlet orifices of the injection orifices (23) in the inner wall of the sleeve (19).

13. A fuel injection valve as claimed in claim 1, wherein the sealing face (13) on the valve-member head (11) is formed by a seat ring (15) placed onto the end of the sleeve (19) located on the combustion-space side, the valve-member head (11) having a shoulder which is adjacent to a shank part of the valve member (9) and on which the seat ring (15) comes to bear on the combustion-space side.

14. A fuel injection valve as claimed in claim 13, wherein the inflow duct (25) is formed by a plurality of axial ground-down portions (43) which correspond to the number of injection orifices (23) arranged in a radial plane in the sleeve (19) and which are located in a shank of the valve member (9) in the portion (21) of an overlap with the sleeve (19) upstream of the valve member head (11).

15. A fuel injection valve as claimed in claim 13, wherein the inflow duct (25) is formed by a plurality of axial grooves (47) which correspond to the number of injection orifices (23) arranged in a common radial plane of the sleeve (19) and are located in a shank of the valve member (9) in the portion (21) of an overlap with the sleeve (19) upstream of the valve member head (11) and which extend from the pressure space (29) into the region of the inlet orifices of the injection orifices (23).

16. A fuel injection valve as claimed in claim 13, wherein the inflow duct is formed by a portion (43) ground down on one side of a shank of the valve member (9) in the portion (21) of an overlap with the sleeve (19) upstream from the valve member head (11) which opens, at its end located on the combustion-space side, into an annular groove (45) which is located on the valve-member shank and which overlaps the inlet orifices of the injection orifices (23) in the inner wall of the sleeve (19).

17. A fuel injection valve as claimed in claim 1, wherein the inflow duct (25) is formed by a plurality of axial grooves (47) which correspond to the number of injection orifices (23) arranged in a common radial plane of the sleeve (19) and are located in a shank of the valve member (9) in the portion (21) of an overlap with the sleeve (19) upstream of the valve member head (11) and which extend from the pressure space (29) into the region of the inlet orifices of the injection orifices (23).

18. A fuel-injection valve for internal-combustion engines of the outward-opening type, comprising a valve body (1), a bore (7) in said valve body, a valve member (9) which is displaceable in said bore (7) of said valve body (1) by a fuel pressure counter to a force of a closing spring (33) and which, at an end of said valve body located on a combustion-space side of said valve, a valve-member head (11) forms a valve-closing member and, on a side of said valve member head (11) facing the valve body (1), said valve member head (11) has at least indirectly a sealing face (13) which forms a sealing edge, said sealing face (13) cooperates with a valve-seat face (17) provided on an end face of the valve body (1) located on the combustion-space side, a sleeve (19) is arranged on the valve member (9) and protrudes into the bore (7) and is provided with injection orifices (23) which are opened as a result of an opening-stroke movement of the valve member (9) and connectable to a pressure space (29) surrounding said valve member, an inflow duct (25) is formed by at least one recess, covered by the sleeve (19), on a portion (21) of the valve member (9) near the valve-member head (11), the sleeve (19) sits firmly on the circumference of said portion (21) of the valve member (9) and forms an axial guide of the valve-member head (11) relative to the valve body (1), wherein a cross section of the inflow duct (25) decreases continuously from the pressure space (29) in a direction of the injection orifices (23).

19. A fuel injection valve as claimed in claim 18, wherein the inflow duct is formed by a portion (43) ground down on one side of a shank of the valve member (9) in the portion (21) of an overlap with the sleeve (19) upstream from the valve member head (11) which opens, at its end located on the combustion-space side, into an annular groove (45) which is located on the valve-member shank and which overlaps the inlet orifices of the injection orifices (23) in the inner wall of the sleeve (19).

20. A fuel injection valve as claimed in claim 18, wherein the inflow duct (25) is formed by a plurality of axial grooves (47) which correspond to the number of injection orifices (23) arranged in a common radial plane of the sleeve (19) and are located in a shank of the valve member (9) in the portion (21) of an overlap with the sleeve (19) upstream of the valve member head (11) and which extend from the pressure space (29) into the region of the inlet orifices of the injection orifices (23).

21. A fuel injection valve as claimed in claim 18, wherein the inflow duct (25) is formed by a plurality of axial ground-down portions (43) which correspond to the number of injection orifices (23) arranged in a radial plane in the sleeve (19) and which are located in a shank of the valve member (9) in the portion (21) of an overlap with the sleeve (19) upstream of the valve member head (11).

22. A fuel-injection valve for internal-combustion engines of the outward-opening type, comprising a valve body (1), a bore (7) in said valve body, a valve member (9) which is displaceable in said bore (7) of said valve body (1) by a fuel pressure counter to a force of a closing spring (33) and which, at an end of said valve body located on a combustion-space side of said valve, a valve-member head (11) forms a valve-closing member and, on a side of said valve member head (11) facing the valve body (1), said valve member head (11) has at least indirectly a sealing face (13) which forms a sealing edge, said sealing face (13) cooperates with a valve-seat face (17) provided on an end face of the valve body (1) located on the combustion-space side, a sleeve (19) is arranged on the valve member (9) and protrudes into the bore (7) and is provided with injection orifices (23) which are opened as a result of an opening-stroke movement of the valve member (9) and connectable to a pressure space (29) surrounding said valve member, an inflow duct (25) is formed by at least one recess, covered by the sleeve (19), on a portion (21) of the valve member (9) near the valve-member head (11), the sleeve (19) sits firmly on the circumference of said portion (21) of the valve member (9) and forms an axial guide of the valve-member head (11) relative to the valve body (1), wherein the inflow duct is formed by a portion (43) ground down on one side of a shank of the valve member (9) in the portion (21) of an overlap with the sleeve (19) upstream from the valve member head (11) which opens, at its end located on the combustion-space side, into an annular groove (45) which is located on the valve-member shank and which overlaps the inlet orifices of the injection orifices (23) in the inner wall of the sleeve (19).

23. A fuel injection valve as claimed in claim 13, wherein the seat ring (15) has in cross section essentially the form of a right-angled triangle including legs which come to bear sealingly on the shoulder and on the shank of the valve member (9).

* * * * *